US007635153B2

(12) United States Patent
Anderson

(10) Patent No.: US 7,635,153 B2
(45) Date of Patent: Dec. 22, 2009

(54) WASTE COLLECTION APPARATUS

(75) Inventor: Bruce Warren Anderson, Omaha, NE (US)

(73) Assignee: Scoopeeze Brands, LLC, Omaha, NE (US)

( * ) Notice: Subject to any disclaimer, the term of this patent is extended or adjusted under 35 U.S.C. 154(b) by 0 days.

(21) Appl. No.: 12/284,212

(22) Filed: Sep. 19, 2008

(65) Prior Publication Data

US 2009/0096226 A1 Apr. 16, 2009

Related U.S. Application Data

(63) Continuation-in-part of application No. 11/729,294, filed on Mar. 27, 2007, which is a continuation-in-part of application No. 11/039,280, filed on Jan. 20, 2005, now Pat. No. 7,374,215.

(60) Provisional application No. 60/786,631, filed on Mar. 27, 2006.

(51) Int. Cl.
*A01K 29/00* (2006.01)
*E01H 1/12* (2006.01)

(52) U.S. Cl. ..... 294/1.3

(58) Field of Classification Search ..... 294/1.3, 294/1.4, 1.5, 55; 119/161; 15/104.8, 257.1, 15/257.6

See application file for complete search history.

(56) References Cited

U.S. PATENT DOCUMENTS

| | | | | | |
|---|---|---|---|---|---|
| 3,929,363 | A * | 12/1975 | Kahan | 294/1.4 |
| 4,014,584 | A * | 3/1977 | Bau | 294/1.4 |
| 4,247,139 | A * | 1/1981 | Grieb | 294/1.4 |
| 5,056,842 | A * | 10/1991 | Lindenberg et al. | 294/1.4 |
| 6,086,123 | A * | 7/2000 | Sowinski et al. | 294/1.3 |
| 6,986,325 | B1 * | 1/2006 | Hsu | 119/867 |
| 7,374,215 | B2 * | 5/2008 | Anderson | 294/1.3 |

* cited by examiner

*Primary Examiner*—Dean J Kramer
(74) *Attorney, Agent, or Firm*—Suiter Swantz pc llo

(57) ABSTRACT

A lining assembly for lining an apparatus for collecting waste comprises a first lining region, the first lining region including at least two protruding ledges and at least one folded over region; a second lining region coupled to the first lining region, the second lining region including at least two protruding ledges and at least one folded over region; and a pivot axis formed from the hinged coupling of the first lining region and the second lining region configured to allow the first lining region and the second lining region to substantially form an enclosed region when the edges of the first lining region and the second lining region are in contact.

19 Claims, 16 Drawing Sheets

WASTE COLLECTION APPARATUS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the following Related Application(s)):

1. For purposes of the USPTO extra-statutory requirements, the present application incorporates by reference in its entirety and constitutes a continuation-in-part of U.S. patent application Ser. No. 11/729,294, entitled WASTE COLLECTION APPARATUS, naming Bruce Warren Anderson as inventor, filed Mar. 27, 2007, which is currently co-pending, or is an application of which a currently co-pending application is entitled to the benefit of the filing date.

2. For purposes of the USPTO extra-statutory requirements, the present application incorporates by reference in its entirety and constitutes a continuation-in-part of U.S. patent application Ser. No. 11/039,280, entitled WASTE COLLECTION APPARATUS, naming Bruce Warren Anderson as inventor, filed Jan. 20, 2005, now U.S. Pat. No. 7,374,215 which is currently co-pending, or is an application of which a currently co-pending application is entitled to the benefit of the filing date, which in turn claims the benefit under 35 U.S.C. § 119 of U.S. Provisional Application No. 60/786,631, filed on Mar. 27, 2006.

FIELD

The various embodiments of the present invention relate generally to waste collection apparatuses and more particularly to a solid animal waste collection apparatus.

BACKGROUND

Animal waste collection is a daily occurrence for those who must walk their pets in public areas. Because a pet owner must constantly clean up after his pet, the pet owner necessarily uses a great number of containers for such purpose. Typically, plastic bags are employed, and pet owners may spend a significant amount of money on such waste disposal bags, particularly if they are sold as part of a waste collecting device and system that requires bags specifically configured to function with the waste collecting device. In the United States and many other countries, it is common for shoppers to save plastic grocery bags for various uses around the home, and thus, the waste collecting arts would benefit from a waste collecting device that seeks to employ these bags. With millions of domesticated pets in the United States alone, cleaning up waste can be a major problem in many urban and suburban areas in the U.S. and other cities around the world. Today in many cities it is mandatory, in others it is requested. In all cases, the easier and less offensive the process of waste collection is, the more people will act responsibly in cleaning up after their pet in an environmentally friendly way.

The problems associated with other means of picking up canine waste material are that they are awkward to prepare for use, or they require the pet owner to use their hand to pick up the waste, or they require the pet owner to carry a bag of waste exposed to the public until they find a suitable trash receptacle, or they require carrying an additional device not integrated into the pet leashing system. Consequently, an apparatus for effectively collecting animal waste is needed.

SUMMARY

Accordingly, the various embodiments of the present invention are directed to an apparatus for collecting solid animal waste. According to a first embodiment, a lining assembly for lining an apparatus for collecting waste is disclosed comprising, but not limited to: a first lining region defining a first containing area, the first lining region including at least two protruding ledges positioned to extend substantially outward from opposite edges of the first lining region and at least one folded over region extending substantially across at least one edge of the first lining region forming a slot through which an edge of a waste collection assembly may be inserted; a second lining region defining a second containing area hingedly coupled to the first lining region, the second lining region including at least two protruding ledges positioned to extend substantially outward from opposite edges of the second lining region and at least one folded over region extending substantially across at least one side of the second lining region forming a slot through which an edge of a waste collection assembly may be inserted; and a pivot axis formed from the hinged coupling of the first lining region and the second lining region configured to allow the first lining region and the second lining region to substantially form an enclosed region when the edges of the first lining region and the second lining region are in contact.

According to a second embodiment, a lining assembly for lining an apparatus for collecting waste is disclosed comprising, but not limited to: a first lining region defining a first containing area, the first lining region including at least two protruding ledges positioned to extend substantially outward from opposite edges of the first lining region and at least one folded over region extending substantially across at least one edge of the first lining region forming a slot through which an edge of a waste collection assembly may be inserted; a second lining region defining a second containing area coupled to the first lining region, the second lining region including at least two protruding ledges positioned to extend substantially outward from opposite edges of the second lining region and at least one folded over region extending substantially across at least one side of the second lining region forming a slot through which an edge of a waste collection assembly may be inserted, the first lining region and the second lining region being hingedly connected; and a pivot axis formed from the hinged connection of the first lining region and the second lining region configured to allow the first lining region and the second lining region to substantially form an enclosed region when the edges of the first lining region and the second lining region are in contact; a plurality of first tab assemblies disposed on the at least one protruding ledges of the first lining region; and a plurality of second tab assemblies disposed on the at least one protruding ledges of the second lining region matable with the plurality of first tab assemblies.

According to a third embodiment, a lining assembly for lining an apparatus for collecting waste is disclosed comprising, but not limited to: a first semi-cylindrical lining region, the first semi-cylindrical lining region including at least one protruding ledge positioned to extend substantially outward from an edge of the first semi-cylindrical lining region and at least one folded over region extending substantially across at least one side of the first semi-cylindrical lining region forming a slot through which an edge of a waste collection assembly may be inserted; a second semi-cylindrical lining region coupled to the first semi-cylindrical lining region, the second semi-cylindrical lining region including at least one protruding ledge positioned to extend substantially outward from an edge of the second semi-cylindrical lining region and at least one folded over region extending substantially across at least one side of the second semi-cylindrical lining region forming a slot through which an edge of a waste collection assembly may be inserted, the first semi-cylindrical lining region and the second semi-cylindrical lining region being hingedly connected; a substantially centrally located pivot axis formed from the hinged connection of the first semi-cylindrical lining region and the second semi-cylindrical lining region configured to allow the first semi-cylindrical lining region and the second semi-cylindrical lining region to substantially form a cylinder when the edges of the first semi-cylindrical lining region and the second semi-cylindrical lining region are in contact; a plurality of first tab assemblies disposed on the at least one protruding ledges of the first semi-cylindrical lining region; and a plurality of second tab assemblies disposed on the at least one protruding ledges of the second semi-cylindrical lining region matable with the plurality of first tab assemblies.

Advantageously, waste collection apparatus is configured to couple to any common leashing system utilized by animal owners for walking the animal. The waste collection apparatus allows a pet owner to easily and quickly collect and contain waste material in a sanitary, inexpensive, disposable and bio-degradable container, and to discretely transport the without having to carry an additional device in a free hand, or further encumber the leash hand until the waste can be properly disposed.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Figure 1:
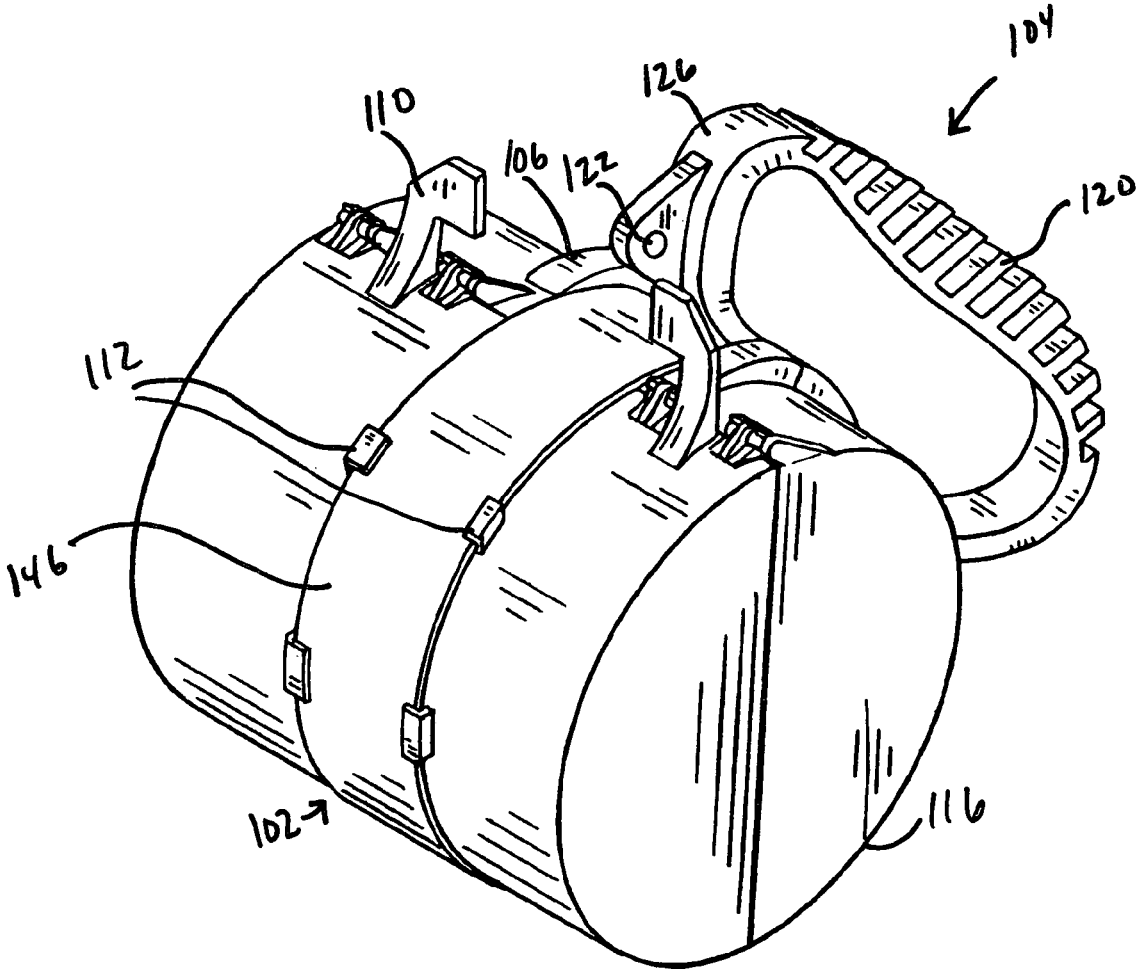
FIG. 1 is an isometric view of waste collection apparatus in a closed position in accordance with embodiments of the present invention.

Reference will now be made in detail to presently preferred embodiments of the invention, examples of which are illustrated in the accompanying drawings.

Referring to FIGS. 1-15C, illustrations of a waste collection apparatus 100 in accordance with an exemplary embodiment of the present invention are shown. Waste collection apparatus 100 comprises a containing assembly 102 suitable for containing an amount of solid waste and a handle assembly 104 coupled to the containing assembly. Containing assembly 102 further comprises an outer semi-circle, referred to in this application as an exterior shell assembly comprising at least two exterior shell assembly components 114, 116, an inner semi-circle, referred to in this application as an interior shielding assembly (not shown) and a liner, referred to in this application as a lining assembly 140 suitable for lining the interior shielding assembly and protecting the interior shielding assembly and the interior of the exterior shell assembly from the animal waste. Handle assembly 104 may further comprise an aperture suitable for insertion of a leash attachment assembly therethrough.

In an additional embodiment, waste collection apparatus 100 comprises a containing assembly 102 and a handle assembly 104. Containing assembly 102 comprises an exterior shell assembly 102 and a lining assembly 140. Exterior shell assembly comprises at least two exterior shell assembly components 114, 116 separably coupled along an axis to form a cavity. Exterior shell assembly components may be separated via at least one depressible tab 110 actuated by a user to open the containing assembly.

Figure 2A:
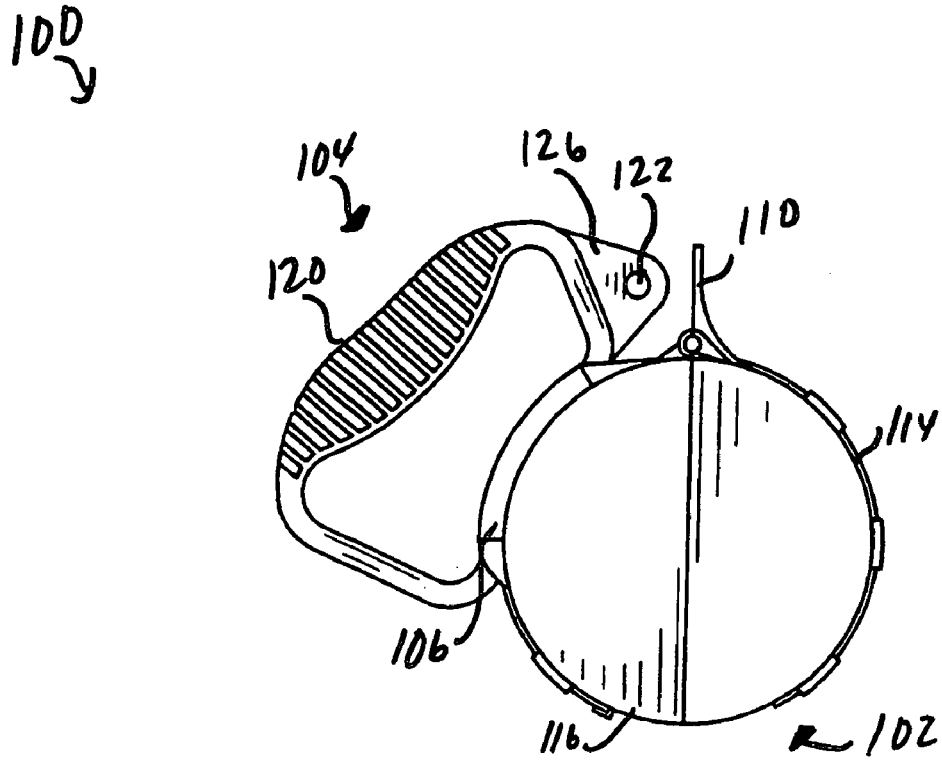
FIGS. 2A and 2B are side views of a waste collection apparatus in a closed position in accordance with embodiments of the present invention.
Figure 2B:
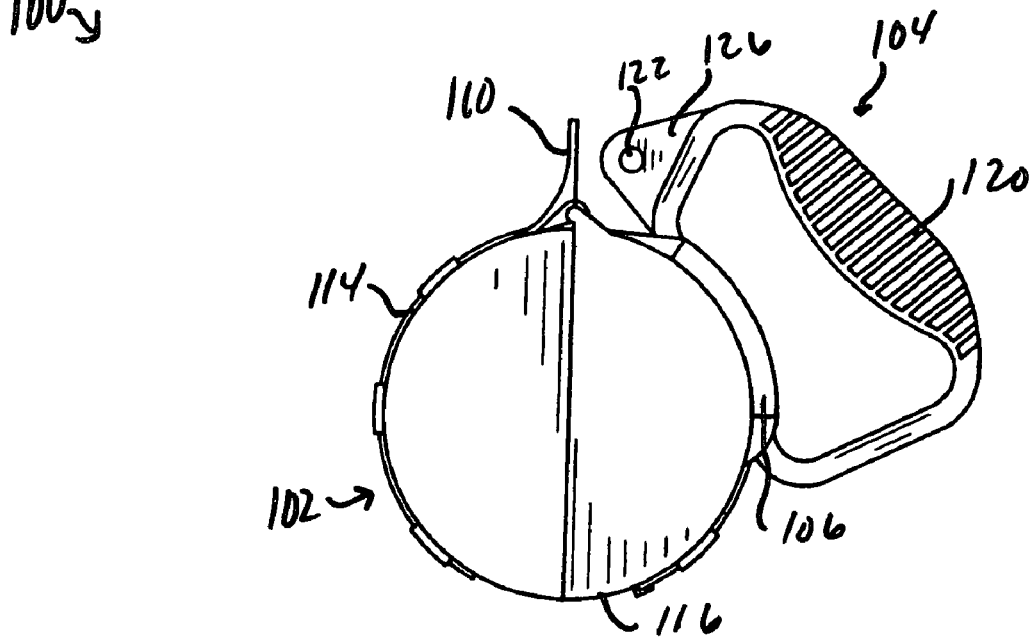
Figure 3:
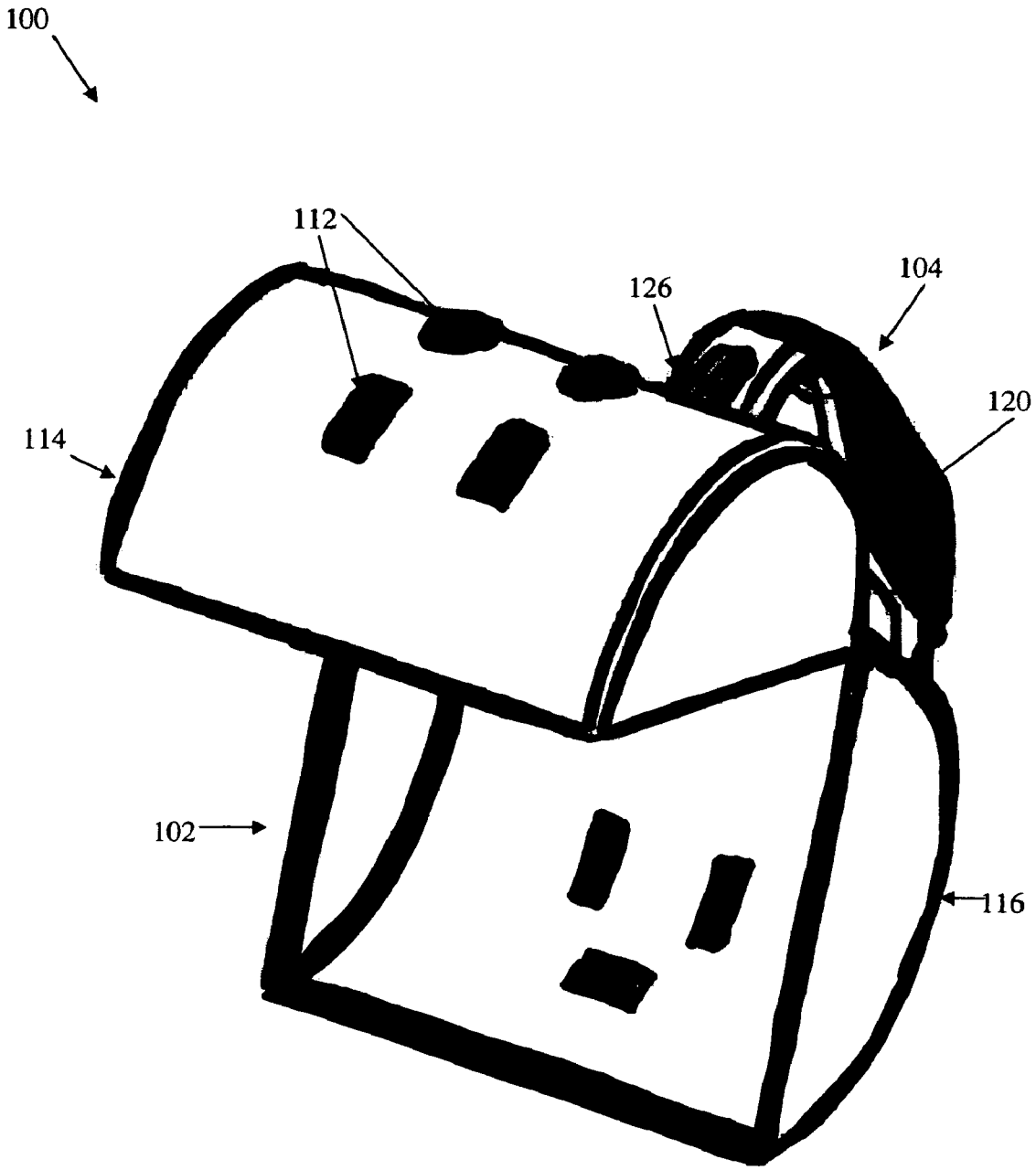
FIG. 3 is an isometric view of a waste collection apparatus in an open position in accordance with embodiments of the present invention.
Figure 4A:
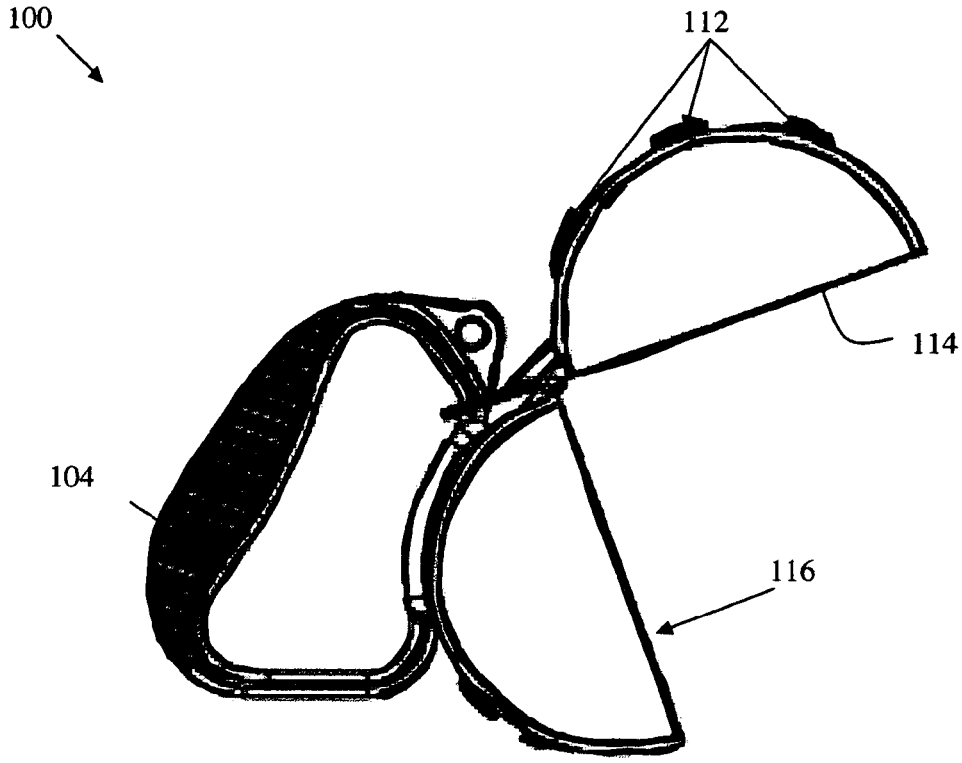
FIGS. 4A and 4B are side views of a waste collection apparatus in an open position in accordance with embodiments of the present invention.
Figure 4B:
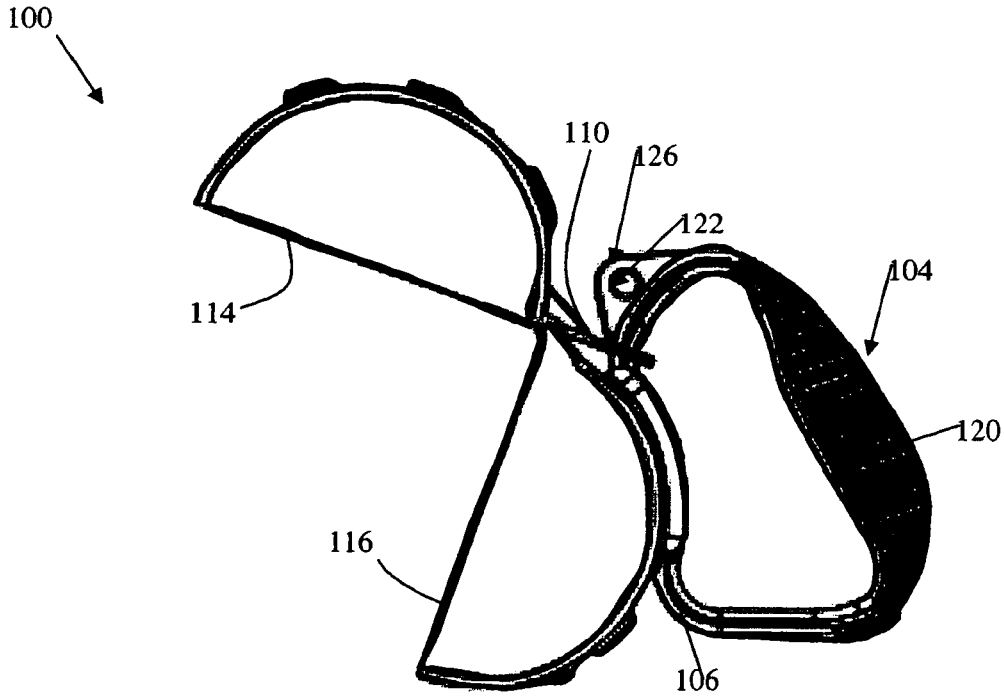
Figure 5A:
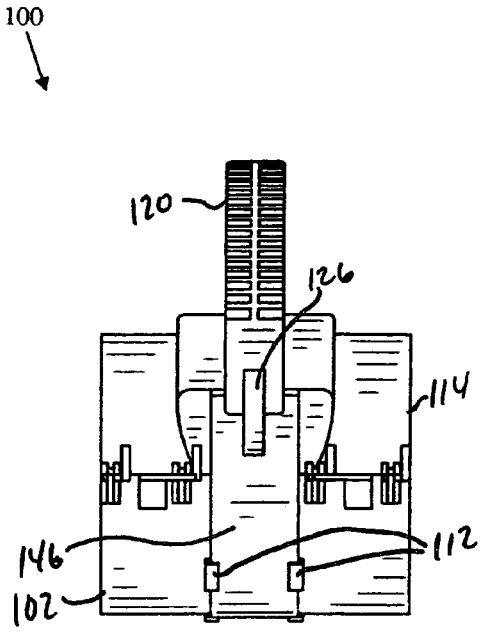
FIGS. 5A, 5B and 5C are top elevation views of a waste collection apparatus in a closed position in accordance with embodiments of the present invention.
Figure 5B:
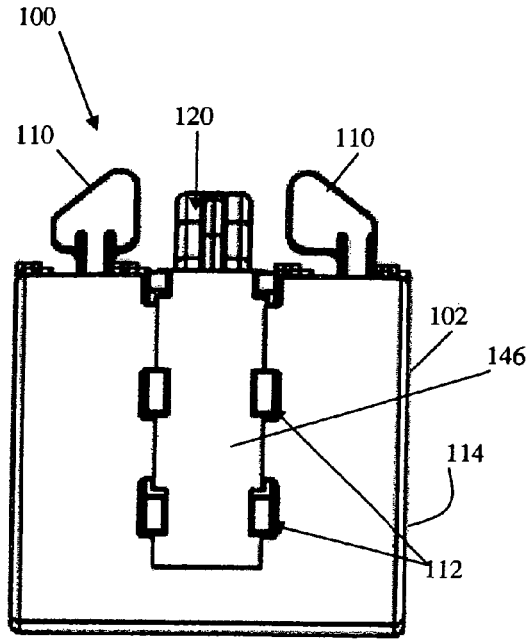
Figure 5C:
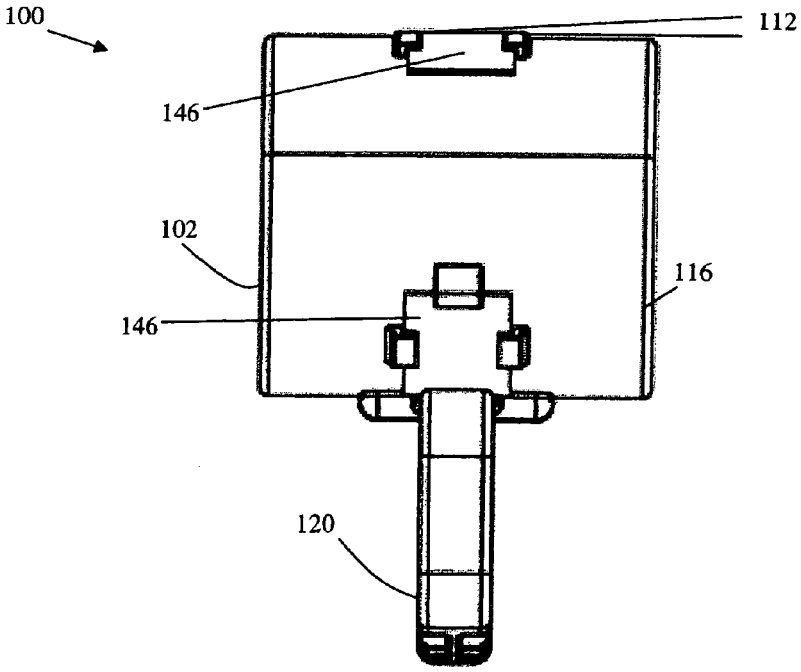
Figure 6:
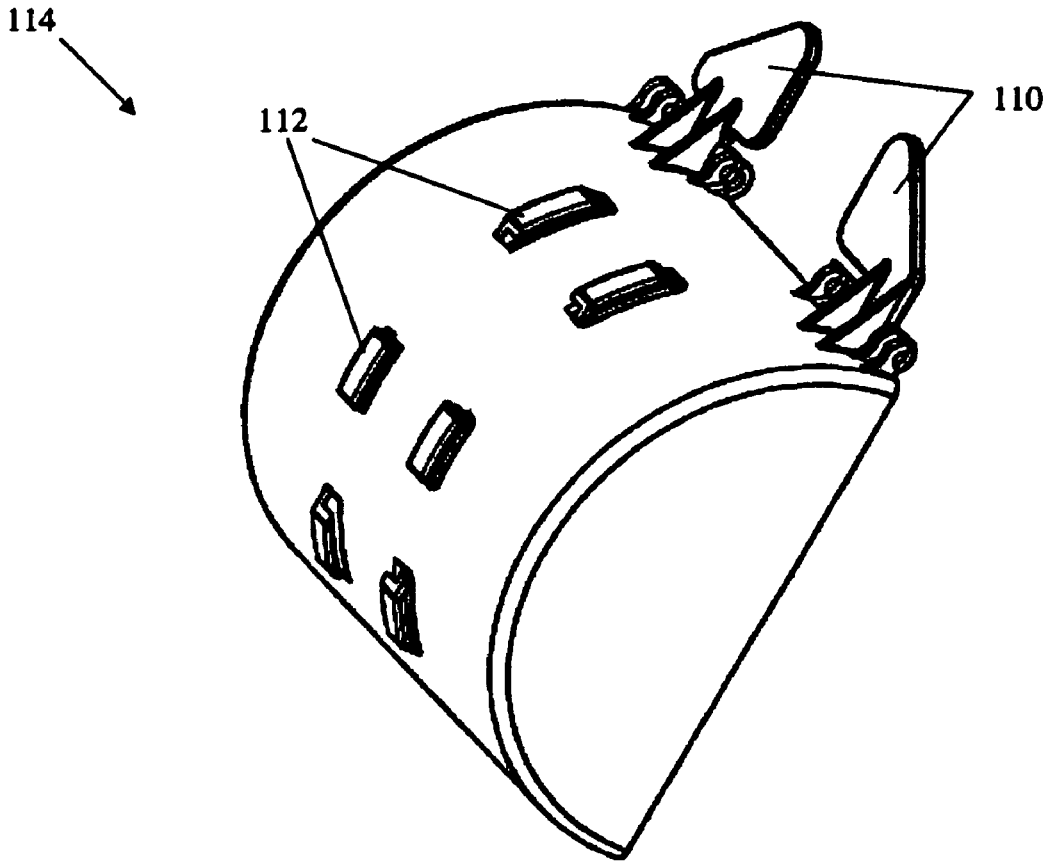
FIG. 6 is an isometric view of waste collection apparatus containing assembly component in accordance with embodiments of the present invention.

FIGS. 1, 2A and 2B illustrate the waste collection apparatus 100 in the closed state. Exterior shell assembly components 114, 116 comprise separable "jaw like" ends, pivot ends opposite the jaw ends and a pin-bearing intermediate section between the jaw-like ends and pivot ends. The pivot ends of exterior shell assembly components are pivotally affixed by means of jaw pivot pins. Intermediate section track pins are affixed to the exterior shell assembly components 114, 116. Jaw ends may be substantially flat across, or may comprise an undulating surface having ridges and valleys or teeth which intermesh so as to move through grass more effectively and hold the waste-laden bag securely.

It should be noted that the motion of the jaw ends of the exterior shell assembly components 114, 116 corresponds to the path defined by the pivot alignment pin. This allows the exterior shell assembly components 114, 116 to slide under the waste material as they move directly toward one another (i.e., in the second direction) and as they move upward (i.e., in the first direction) into the shell.

Waste collection apparatus 100 may be openable via an opening assembly 110 suitable for separating the two components of the exterior shell assembly 114, 116. The opening assembly 110 comprises a release mechanism such as a depressible tab suitable for initiating separating of the two components of the exterior shell assembly 114, 116 at the point where the exterior shell assembly components separably contact one another. Opening assembly 110 may comprise a spring loaded securing mechanism configured to maintain contact of the exterior shell assembly components 114, 116 when the release mechanism has not been initiated. When the user applies force to the release mechanism so as to compress the spring mechanism, the exterior shell assembly components 114, 116 separate to allow the ingress or egress of material as desired by the user. Opening, collecting of waste, and closing of the waste collection apparatus 100 may be performed with only one hand, leaving the other free.

Referring to FIGS. 6-12B, illustrations of exterior shell assembly components 114, 116 of a waste collection apparatus 100 according to an exemplary embodiment of the present invention are shown. Containing assembly 102 may comprise an exterior shell assembly, further comprising exterior shell assembly components 114, 116 suitable for a providing durable protective outer shell for the waste collection apparatus 100 when coupled. The first and second exterior shell assembly components 114, 116 may be composed of a durable heavy gauge plastic, nylon, or composite, or other synthetic material that exterior shell assembly forms approximately a 315 degree concave arc that is open on both ends.

It is contemplated that the diameter of the arc and the width of the waste collection apparatus components (first and second exterior shell assembly components 114, 116, interior shielding assembly and lining assembly 140) may be modified for adapting with leashes of varying sizes, or waste material of varying quantities suitable for use with small, medium, or large size animals. Example of some approximate sizes may include:

| | | | | |
|---|---|---|---|---|
| Small | Dia | 3 inches | Width | 3 inches |
| Medium | Dia | 4 inches | Width | 4 inches |
| Large | Dia | 7 inches | Width | 7 inches |

The exterior shell assembly components 114, 116 may comprise a mounting assembly 150 suitable for mounting the handle assembly 104 to the containing assembly 102. Handle assembly 104, or a retractable leashing assembly (not shown) may be mountable to a substantially upwardly located region of one of the exterior shell assembly components 114, 116. In one embodiment, a first end of the handle assembly 104 is positioned substantially along a pivotable axis coupling the first and second exterior shell assembly components 114, 116. Handle assembly 104 may be mounted perpendicular to the pivotable axis and may extend substantially downward. A second end of the handle assembly 104 may be positioned in a lower region of the second exterior shell assembly component 116. The handle assembly 104 comprises a bracket member 126 further comprising an aperture 122 suitable for coupling with the coupling mechanism of a normal, non-retracting leash. When attached to a standard leash the handle assembly 104 is configured to provide a comfortable and solid griping surface. The exterior shell assembly of waste collection apparatus 100 further comprises a docking unit such as a mounting plate 150 which allows the connection of any third party retractable leash to the upper area of the waste collection apparatus 100. Mounting plate may be revealed when handle assembly 104 is detached from the containing assembly 102. Mounting plate may be suitable for coupling with any standard retractable leash, and may couple specifically to an underside portion of the retractable leash.

Exterior shell assembly may comprise a band 146 coupled to an exterior surface of the exterior shell assembly and wrapping substantially about the entirety of the exterior shell assembly. Band 146 may be metal, metal alloy, plastic, or any material suitable for providing substantially pressure or force to assist in maintaining a closed configuration for the containing assembly until opened by actuating at least one depressible tab. Band 146 may be coupled substantially centrally, or may be coupled substantially nearer to one end or another of the containing assembly. Band 146 may wrap substantially downwardly from and perpendicularly to the pivot axis assembly of the exterior shell assembly, such that a first portion of the band extends downward across a region of a first exterior shell assembly component 114, and a second portion of the band extends downward across a region of the second exterior shell assembly component 116. Second exterior shell assembly component 116 may also comprise a mounting assembly 150 suitable for mounting to a handle assembly 104 or a retractable leash mounting plate 108. To this end, band 146 may be coupled to the second exterior shell assembly 116 substantially underneath the mounting assembly 150. Band 146 may be secured in place by a plurality of securing tabs 112. Band 146 may be coupled to exterior shell assembly via any coupling means, and may be permanently or removably coupled to the exterior shell assembly.

Figure 7:
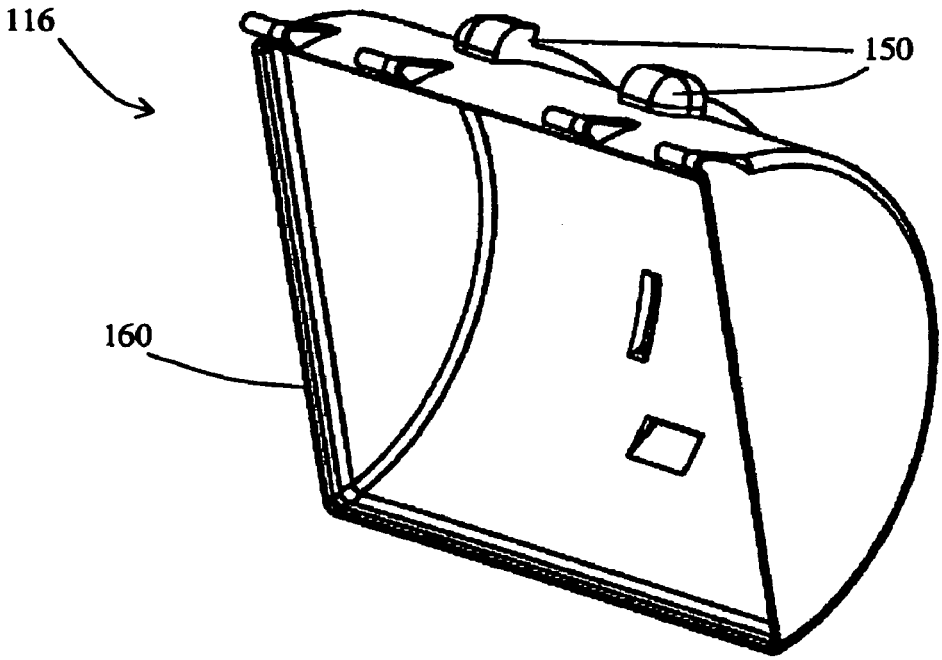
FIG. 7 is an isometric view of waste collection apparatus containing assembly component in accordance with embodiments of the present invention.
Figure 8A:
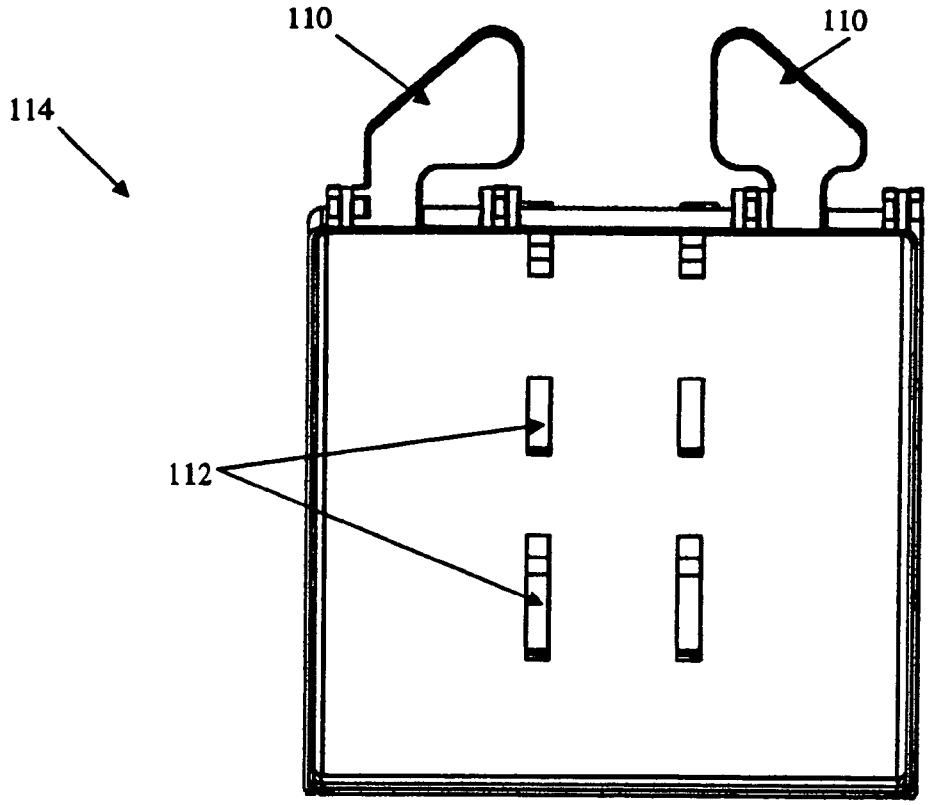
FIGS. 8A and 8B are top elevation views of a waste collection apparatus containing assembly component in a closed position in accordance with embodiments of the present invention.
Figure 8B:
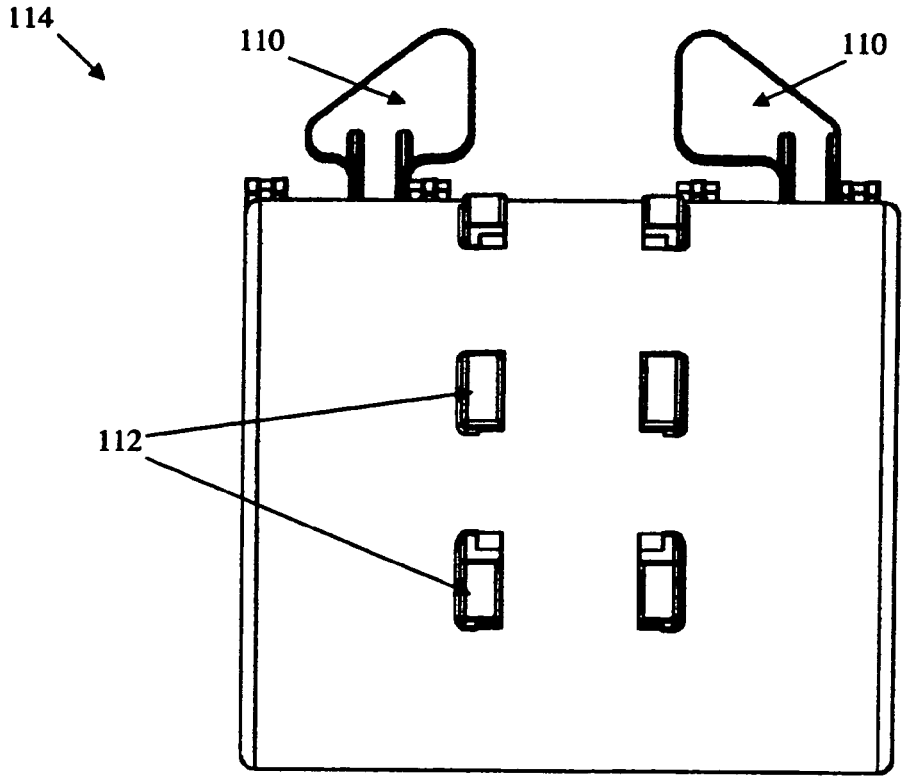
Figure 9A:
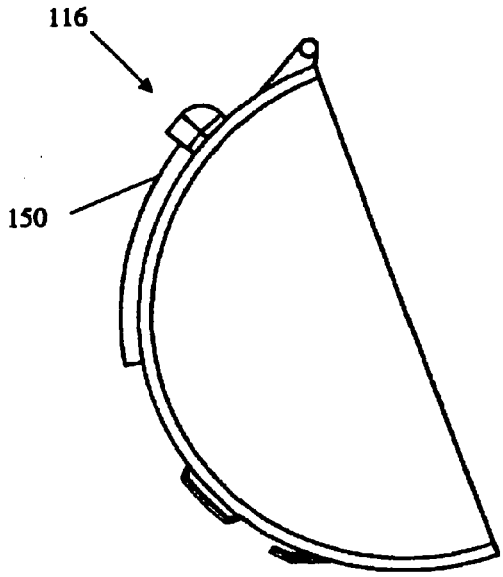
FIGS. 9A and 9B are side views of a waste collection apparatus containing assembly component in accordance with embodiments of the present invention.
Figure 9B:
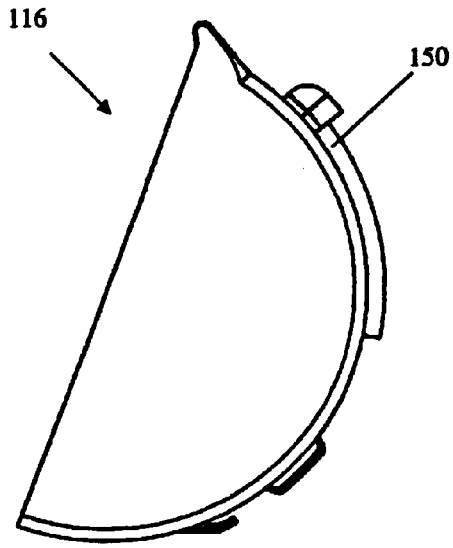
Figure 10A:
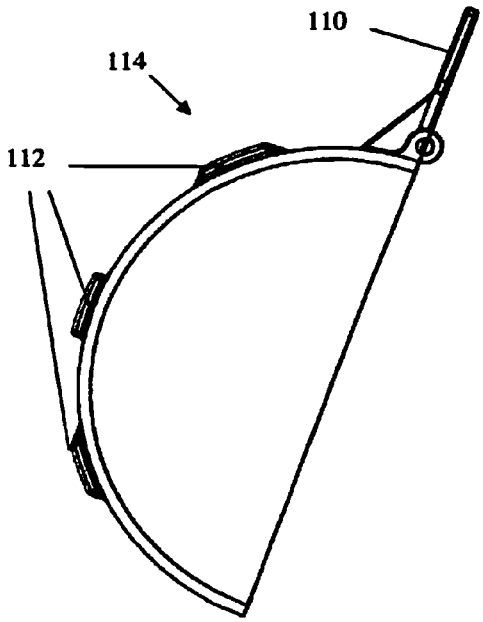
FIGS. 10A and 10B are side views of a waste collection apparatus containing assembly component in accordance with embodiments of the present invention.
Figure 10B:
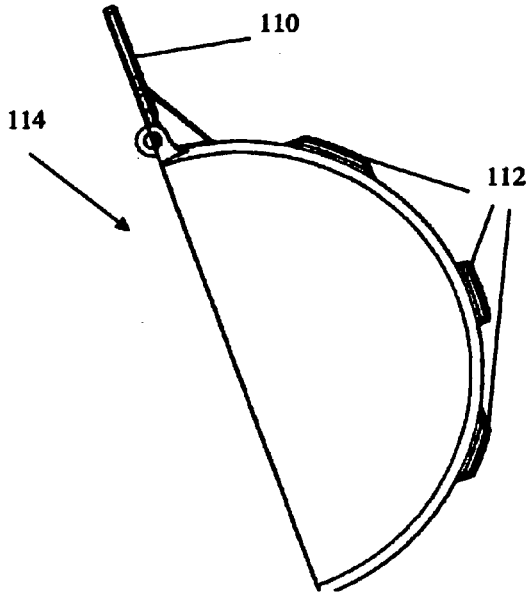
Figure 11A:
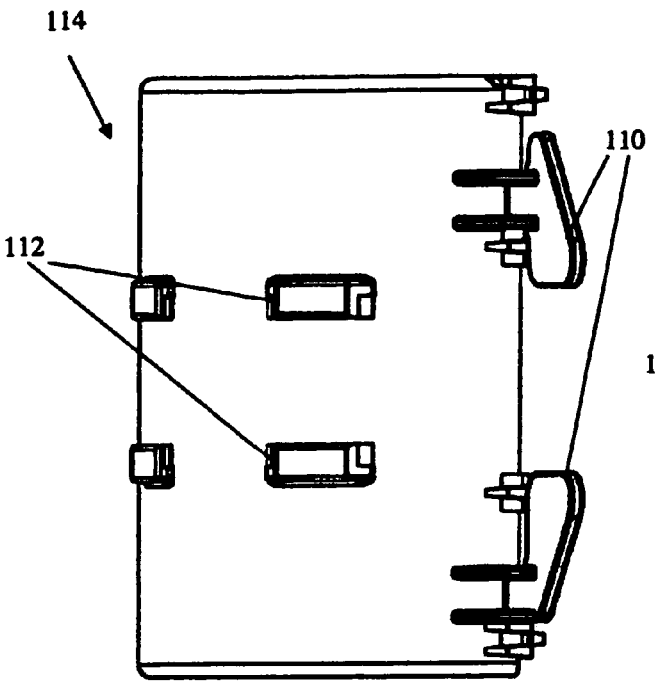
FIGS. 11A and 11B are top elevation views of a waste collection apparatus containing assembly component in accordance with embodiments of the present invention.
Figure 11B:
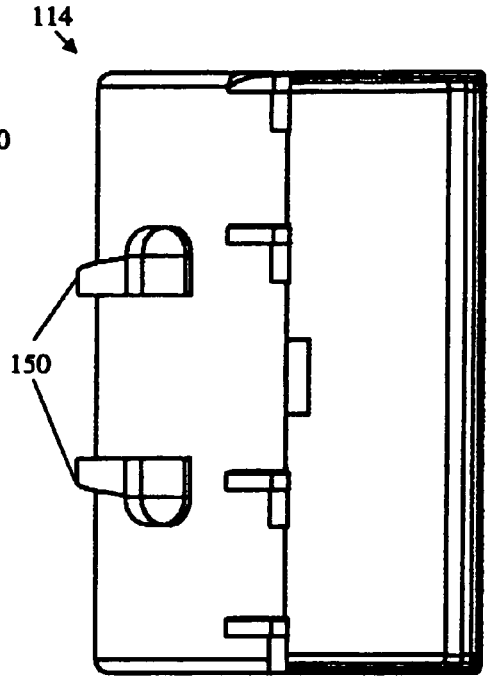
Figure 12A:
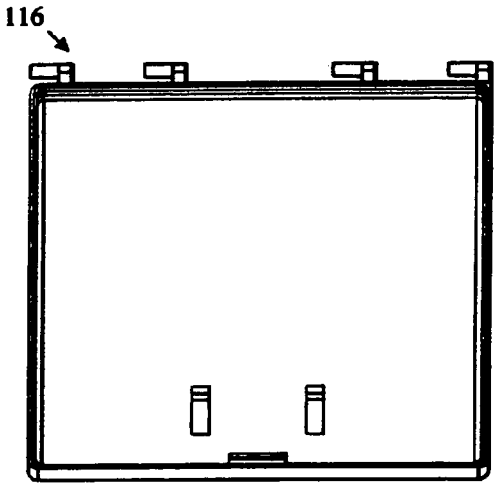
FIGS. 12A and 12B are top elevation views of a waste collection apparatus containing assembly component in accordance with embodiments of the present invention.
Figure 12B:
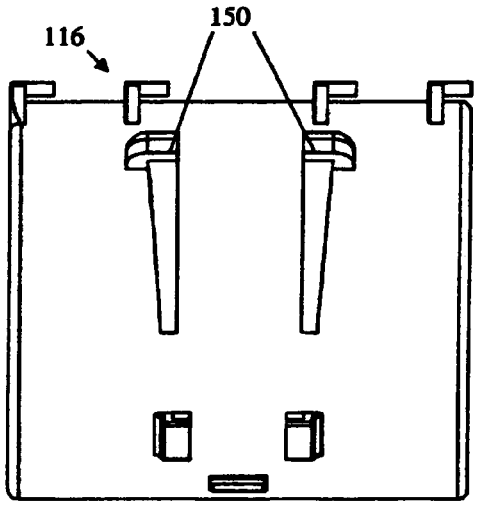
Figure 13A:
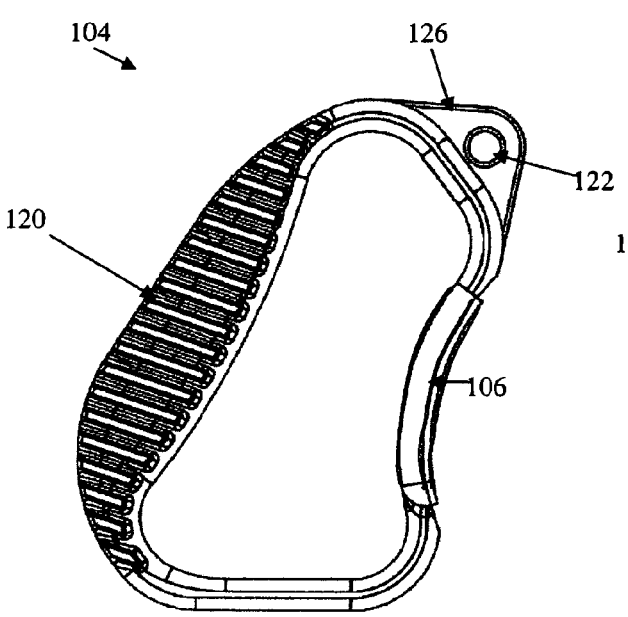
FIGS. 13A, 13B and 13C are side and isometric views of a waste collection apparatus handle assembly in accordance with embodiments of the present invention.
Figure 13B:
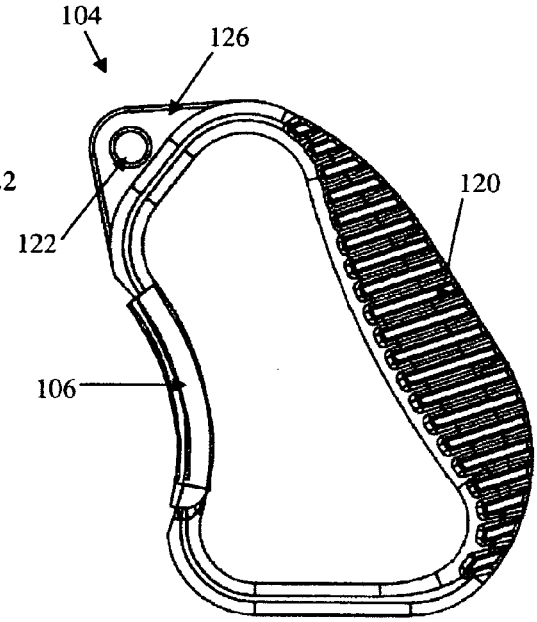
Figure 13C:
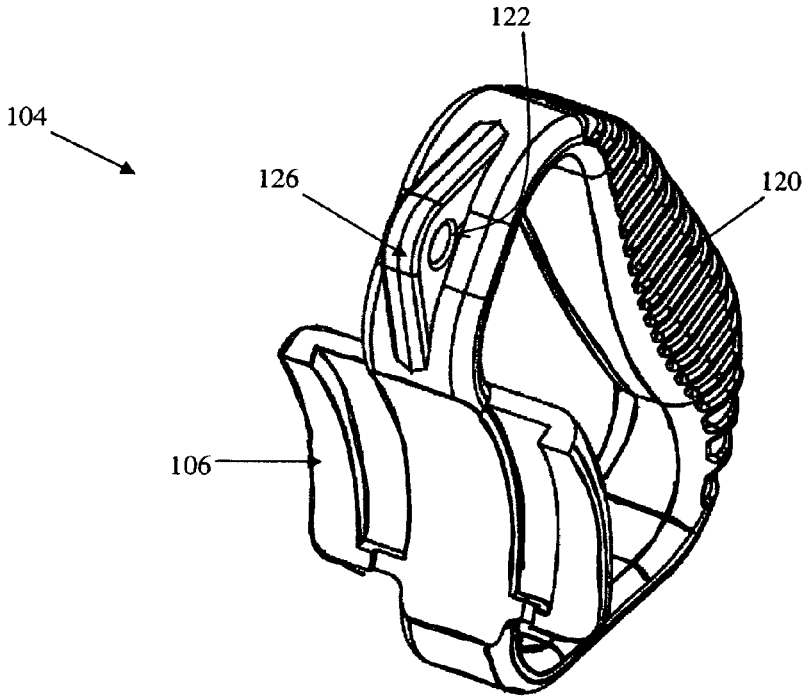
Figure 14A:
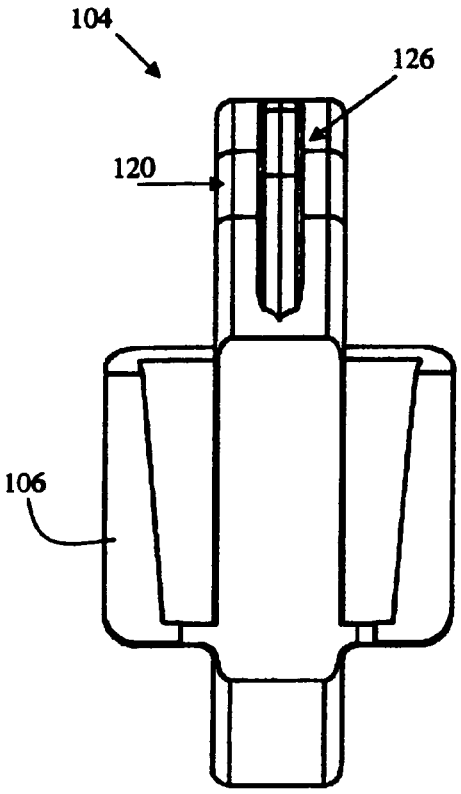
FIGS. 14A, 14B and 14C are top elevation views of a waste collection apparatus handle assembly in accordance with embodiments of the present invention.
Figure 14B:
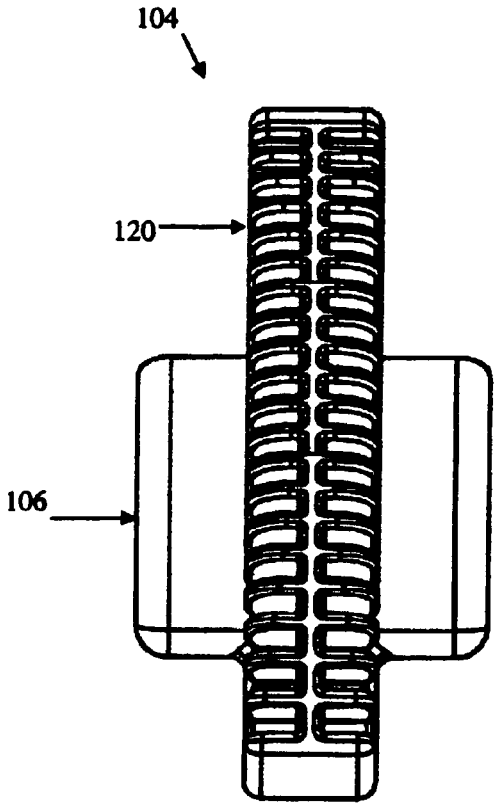
Figure 14C:
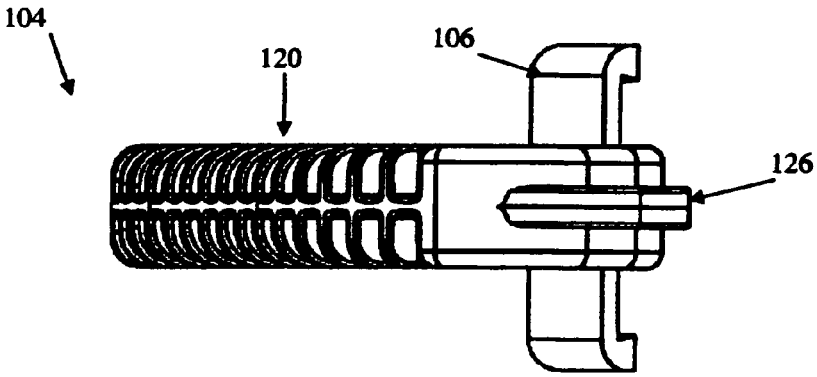

Referring specifically to FIG. 7, an isometric view of an exterior shell assembly component 116 is shown. Any of exterior shell assembly components 114, 116 may further comprise an inset ridged border 160 along the interior perimeter of the exterior shell assembly components 114, 116. Lining assembly 140 may comprise a mating border suitable for setting into the ridged border of the exterior shell assembly components. In this manner, lining assembly 140 may be securely fastened into the cavity of the exterior shell assembly, and may travel with the exterior shell assembly components when the shell components are separated by actuation of the depressible tab 110. In this manner, lining assembly 140 may remain flush or substantially flush with exterior shell assembly when exterior shell assembly components are separated.

The interior shielding assembly or the lining assembly 140 may be formed from polypropylene, plastic or composite or other synthetic material. The size and arc conform to the inner diameter and width of the exterior shell assembly. In one embodiment, the interior shielding assembly may span 180 degrees. In addition, the interior shielding assembly may be closable on first and second opposing ends. At least one of the first and second opposing ends comprises circular or elliptically shaped protrusion, or tab which facilitates the manual rotation of the interior shielding assembly.

In an embodiment comprising an interior shielding assembly, the leading edge of the interior shielding assembly is beveled to create a thin scooping edge to easily lift and move under the waste material. A groove is located in the outer circumference of the leading and trailing edges of the interior shielding assembly to facilitate the positive connection of the lining assembly 140 and the interior shielding assembly.

Referring to FIGS. 13A-14C, illustrations of a handle assembly 104 configured to couple with containing assembly 102 to form a waste collection apparatus 100 according to an exemplary embodiment of the present invention are shown. As shown in FIGS. 13A-14C, the handle assembly 104 comprises a grasping portion 120 and a mounting device 106 further comprising a dovetailed side suitable for interconnecting with an exterior portion of an exterior shell assembly component 116. To this end, the exterior shell assembly component 116 may comprise a mounting assembly 150 such as a tapered securing ramp.

Handle assembly 104 may be releasably matable with containing assembly 102. In one embodiment, the handle assembly 104 and the containing assembly 102 are positioned to lock in contact with each other by slidable engagement between a receiving port on the containing assembly and mating fastener on the handle assembly 104. The slidable engagement may be a dovetail connection between the handle assembly and containing assembly, as will be described further below.

In additional embodiments, handle assembly 104 may be permanently coupled to the containing assembly 102. Handle assembly 104 may be formed with a plurality of slots. Handle assembly may be formed in such a way to provide an ergonomic pattern on a surface of the handle assembly 104 to provide more comfortable gripping of the handle assembly 104.

Handle assembly 104 may be secured to the containing assembly 102, such as, for instance, to an exterior shell assembly component 116. Handle assembly 104 may comprise a mounting device 106 suitable for mating with a mounting plate positioned on the exterior shell assembly component 116. The mounting assembly 150 is configured to receive the mounting device 106 of the handle assembly 104. The mounting assembly 150 may be a tapered securing ramp, further comprising a taper, or dovetail configuration.

A retractable leash assembly may be utilized with an embodiment of the waste collection apparatus 100. When a retractable leash assembly is utilized, a mounting device 108 may be coupled to the retractable leash assembly, and to the mounting assembly 150. As shown in greater detail in FIGS. 15A-16D, a mounting device 108 further comprising a dovetail joint suitable for interconnecting with a mating joint of the mounting plate or bracket 150 portion of the exterior shell assembly component 116. Mounting device 108 may be suitable for coupling a retractable leash assembly to the containing assembly 102. Mounting assembly 150 may be a continuously formed portion of the exterior shell assembly component 116, or may be permanently or releasably coupled to the exterior shell assembly component 116. Releasable coupling of the mounting assembly 150 and the exterior shell assembly component 116 may provide for easy interchange of handle assemblies of different sizes or shapes variations.

Figure 15A:
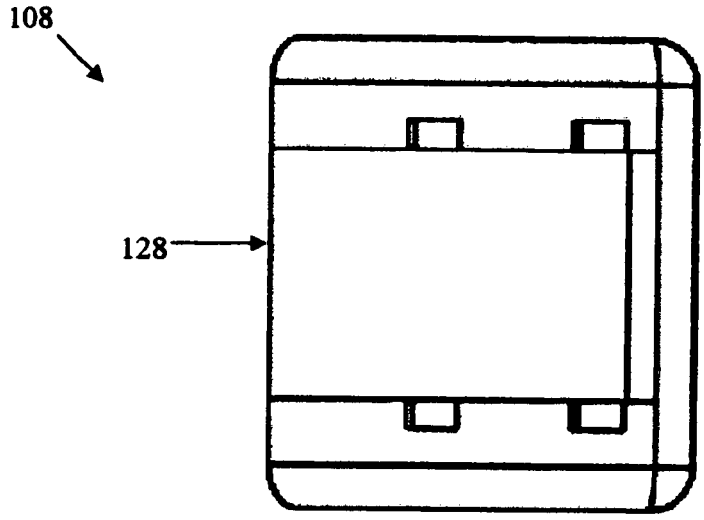
FIGS. 15A, 15B and 15C are top elevation and isometric views of a waste collection apparatus mounting device for retractable leashes in accordance with embodiments of the present invention.
Figure 15B:
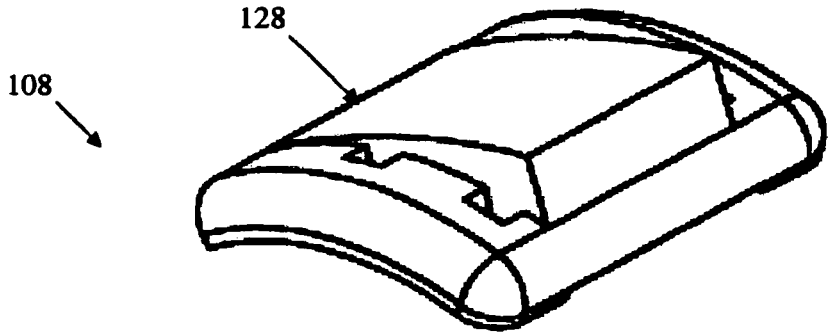
Figure 15C:
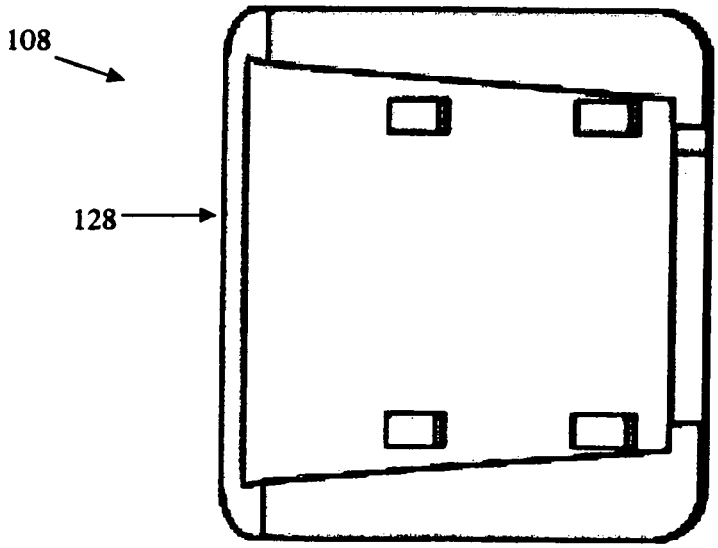
Figure 16A:
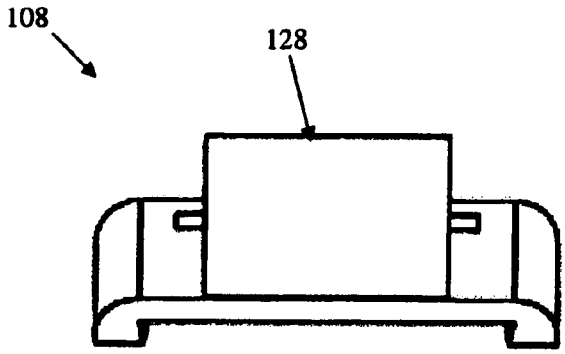
FIGS. 16A, 16B, 16C and 16D are side views of a waste collection apparatus mounting device for retractable leashes in accordance with embodiments of the present invention.
Figure 16B:
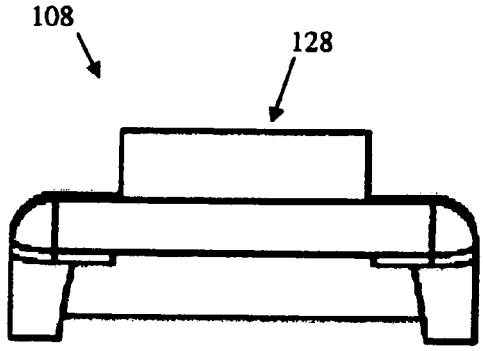
Figure 16C:
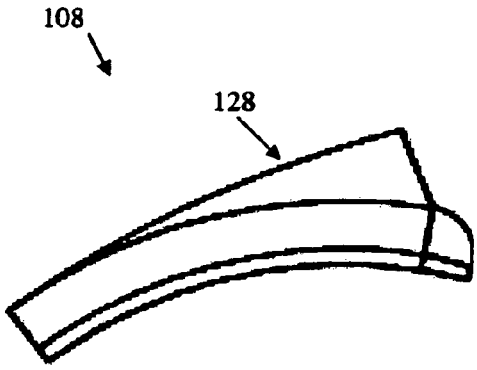
Figure 16D:
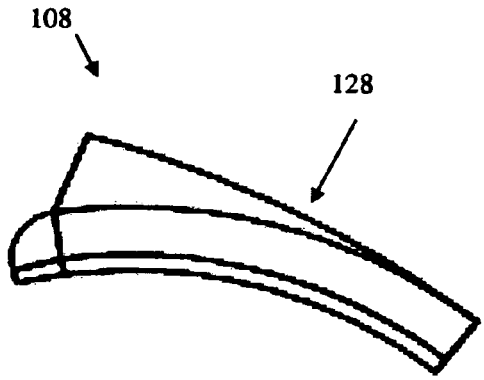
Figure 17:
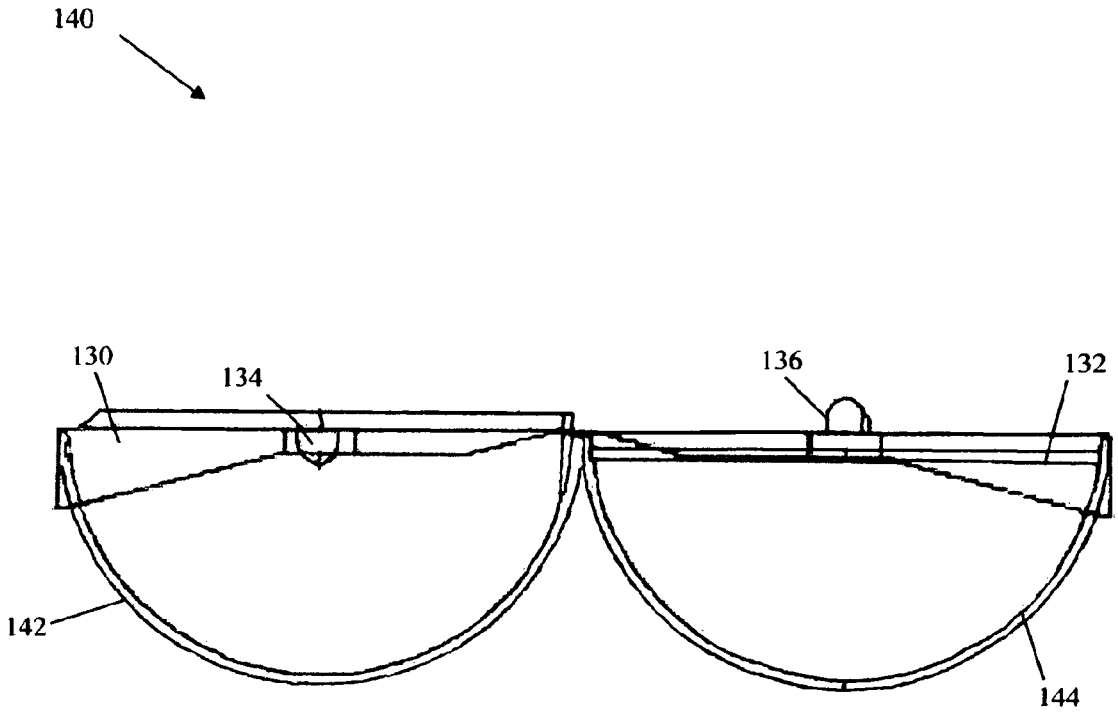
FIG. 17 is a side view of a waste collection apparatus lining assembly in accordance with embodiments of the present invention.
Figure 18:
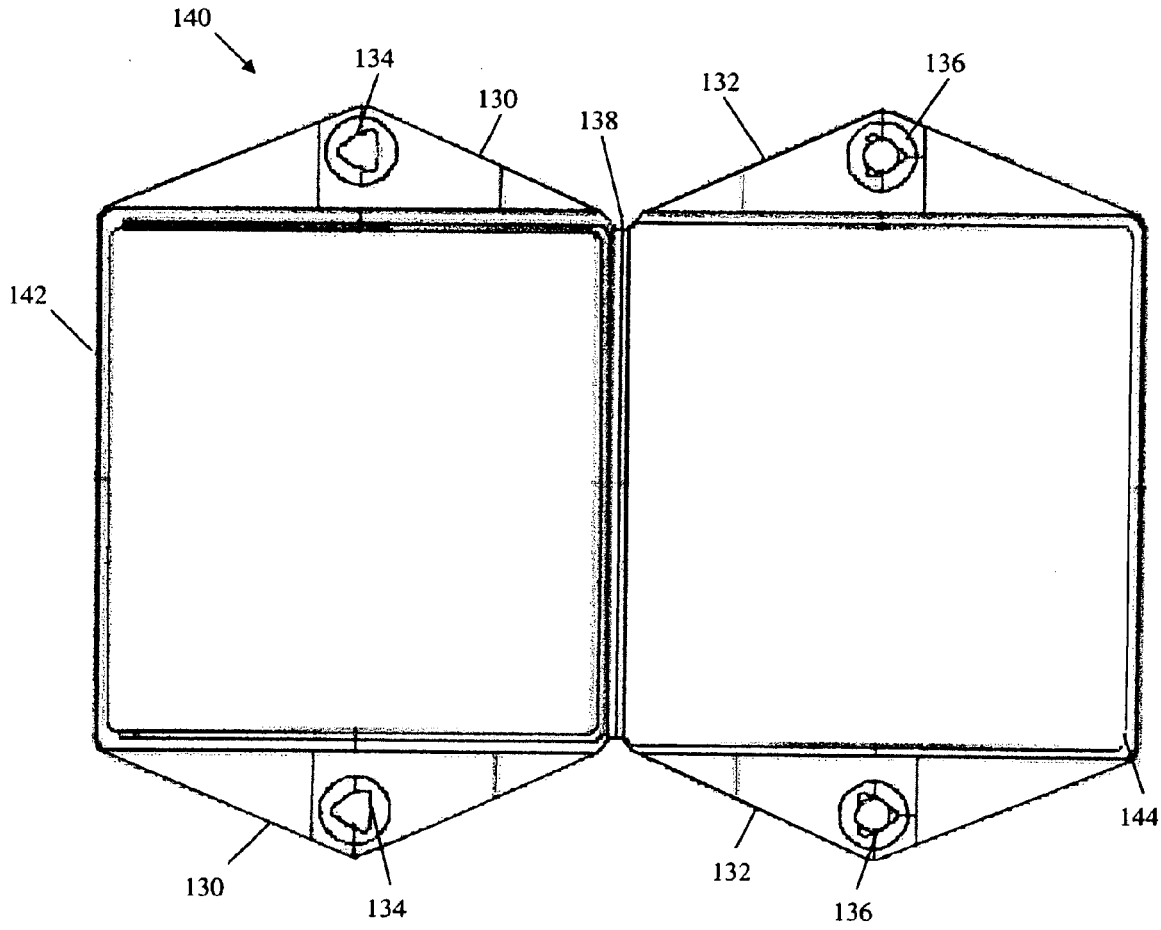
FIG. 18 is a top elevation view of a waste collection apparatus lining assembly in accordance with embodiments of the present invention.
Figure 19A:
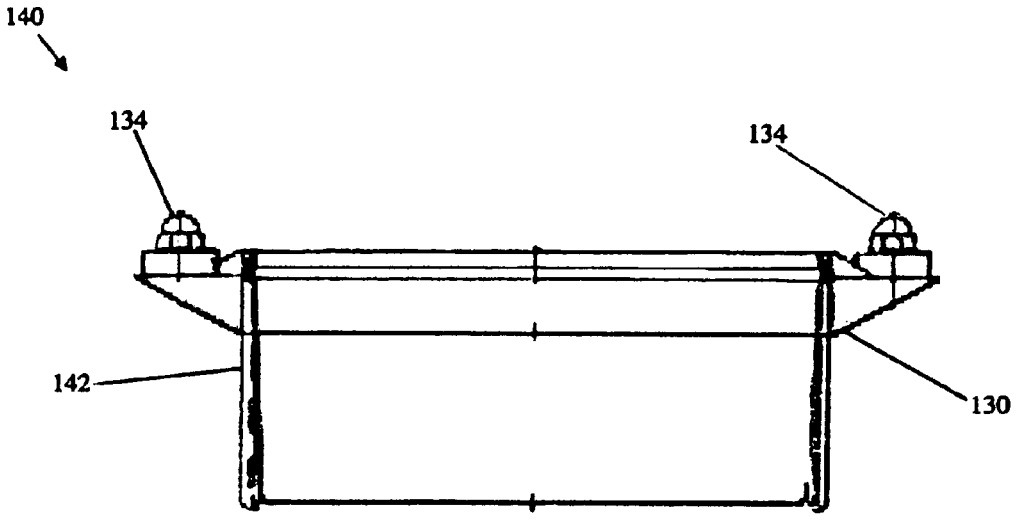
FIGS. 19A and 19B are side elevation views of a waste collection apparatus lining assembly in accordance with embodiments of the present invention.
Figure 19B:
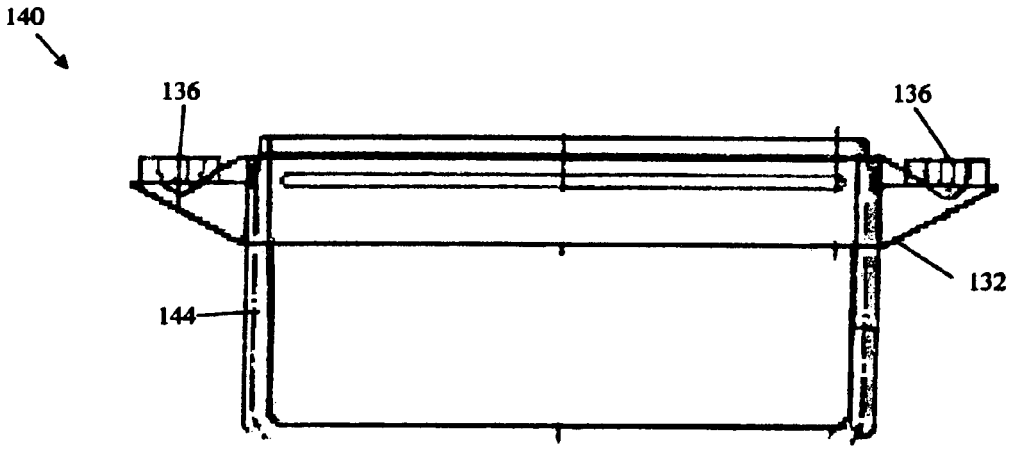

Within the mounting device 108, a center securing ramp 128 is positioned. In FIG. 15B, a front elevational view of the mounting device shows the dovetailed port of the mounting device 106 in greater detail. Dovetailed port is designed to slidably engage with a corresponding and similarly tapered side of the mounting plate on an exterior shell assembly component 116.

Securing ramp 128 may extend from a surface of the mounting device 108 at an angle. The securing ramp 128 may be constructed at any number of angles, including acute angles sufficient to create a taper or dovetailed port opening. The angle can also be chosen to prevent the retractable leash from being easily displaced from the mounting device 106. In the example shown in FIGS. 15A-16D, securing ramp 128 extends from the surface of the mounting device 106 at an angle of approximately 20 degrees. The taper of the securing ramp is one of several techniques that may be utilized to secure the mounting device 108 to the containing assembly 102.

The mounting device 108 may also comprise a curved body molded to conform to the curvature of the containing assembly 102 and a securing ramp 128 suitable for securing a retractable leash assembly to the containing assembly 102. The height of the securing ramp 128 may vary from one end of the curved body to another, allowing secure engagement of the retractable leash assembly and the containing assembly once the handle assembly is in position. The height variation results in an incline utilized to engage the handle assembly 104. As the mounting device 108 slides over the mounting assembly 150, it snaps to a secure position flush against the exterior shell assembly component 116.

The correct positioning of the handle assembly 104 is also ensured by the engagement between a mounting device 106 coupled to the handle assembly 104 and the mounting assembly 150. Mounting device 106 of the handle assembly 104 may be substantially similar to the mounting device 108 utilized to secure a retractable leash assembly to the containing assembly 102. The securing ramp of the mounting devices 106, 108 securely presses against a surface of the mounting plate when either of the mounting devices 106, 108 and the mounting assembly 150 are mated. This ensures that the handle assembly 104 is firmly secured against the containing assembly and in a correct position.

The handle assembly 104 remains flush within the mounting device 106 and the exterior shell assembly component 116 after installation. The dovetail joints of the mounting assembly 150 and the mounting plate respectively, are tapered such that, as the two parts first engage, there is a loose fit. As the handle assembly 104 or the mounting device 108 for retractable leashes is slid into its final position, the gap decreases to a slight press-fit. The dovetail tapers in such a press-fit situation operate to pull the major inside surface of the handle assembly 104 or the mounting device 108 for retractable leashes down against the mounting assembly 150. This ensures that there is no wobble after assembly and that the mounting plate and mounting device snap to keep the components together.

Handle assembly 104 may comprise a raised bracket member 126 further comprising an aperture 122 suitable for insertion of a leash coupling mechanism therethrough. It is to be appreciated that any type of pet animal leash may be employed in connection with the use of the embodiments of present invention described, including leather flat leashes, corded leashes, or chain leashes.

Lining assembly 140 may be configured to wrap substantially about the perimeter edges of the exterior shell assembly components 114, 116. To this end, the lining assembly 140 comprises a lip on all four edges that wraps and covers the edges of the exterior shell assembly components 114, 116. Lining assembly 140 may comprise a centrally located pivot axis 138 configure to allow the lining assembly 140 to be folded substantially in half. Pivot axis 138 may define first and second lining assembly regions 142, 144. First and second lining assembly regions 142, 144 may be semi-circular, square, rectangular and the like. It is contemplated that lining assembly regions 142, 144 may be molded to conform to the shape of the interior cavity regions defined by the exterior shell assembly components. For instance, if the exterior shell assembly components 114, 116 are substantially square, lining assembly regions 142, 144 may be substantially square. However, it is further contemplated that lining assembly 140 and exterior shell assembly may comprise differing shapes from one another without detracting from the functionality of the waste collection apparatus. Lining assembly 140 may further comprise at least one extended edge portion 130 extending beyond the perimeter of at least one exterior shell assembly component. In a preferred embodiment, lining assembly 140 comprises at least two extended edge portions 130, 132 for each lining assembly region 142, 144, respectively, positioned substantially opposite one another. First and second extended edge portions 130 of the lining assembly 140 positioned on opposite lateral edges of a first lining assembly region 142, for instance, along opposite lateral edge portions of a first lining assembly region 142, and each may comprise a male mating mechanism 134, such as a tab, snap, or the like. Third and fourth extended edge portions 132 may be positioned substantially on opposite lateral edges of the second lining assembly region 144, for instance, along opposite lateral edge portions of the second lining assembly region 144, may comprise a female mating mechanism 136 suitable for engaging with the female mating mechanism. Extended edge portions 130, 132 may be suitable for grasping by a user to insert the lining assembly 140 into the cavity of the exterior shell assembly or remove the lining assembly 140 from the cavity of the exterior shell assembly.

In an alternative embodiment lining assembly 140 is suitable for direct insertion into the cavity of the exterior shell assembly. When the apparatus 100 is in the open state, a user may insert the lining assembly 140 substantially into the exterior shell assembly. The lining assembly may comprise a plurality of tabs suitable for removing the lining assembly from the containing assembly exterior shell assembly. The user may manually insert the lining assembly 140 into the cavity formed by the two halves of the exterior shell assembly. The lining assembly tabs are configured to hold the lining assembly in place within the cavity region formed by the exterior shell assembly. Once the lining assembly 140 is installed, the apparatus 100 is ready for use. It is notable that when the preferred lining assembly 140 is utilized, the liner assembly attachment and sealing method requires no secondary or inefficient mechanisms (e.g., clips or adhesives) either on the lining assembly or the interior shielding assembly.

Lining assembly 140 may be configured to wrap substantially about the perimeter edges of the exterior shell assembly components 114, 116. To this end, the lining assembly 140 comprises a lip on all four edges that wraps and covers the edges of the exterior shell assembly components 114, 116. Lining assembly 140 may comprise a substantially centrally located pivot axis 138 configure to allow the lining assembly 140 to be folded substantially in half. Pivot axis 138 may define first and second lining assembly regions 142, 144. First and second lining assembly regions 142, 146 may be semi-cylindrical, box-shaped, bowl-shaped, square, rectangular and the like. It is contemplated that lining assembly regions 142, 146 may be molded to conform to the shape of the interior cavity regions defined by the exterior shell assembly components. For instance, if the exterior shell assembly components 114, 116 are substantially square, lining assembly regions 142, 144 may be substantially square. However, it is further contemplated that lining assembly 140 and exterior shell assembly may comprise differing shapes from one another without detracting from the functionality of the waste collection apparatus. Lining assembly 140 may further comprise at least one extended edge portion 130 extending beyond the perimeter of at least one exterior shell assembly component. In a preferred embodiment, lining assembly 140 comprises at least two extended edge portions 130, 132 for each lining assembly region 142, 144, respectively, positioned substantially opposite one another. First and second extended edge portions 130 of the lining assembly 140 positioned on opposite lateral edges of a first lining assembly region 142, for instance, along opposite lateral edge portions of a first lining assembly region 142, and each may comprise a male mating mechanism 134, such as a tab, snap, or the like. Third and fourth extended edge portions 132 may be positioned substantially on opposite lateral edges of the second lining assembly region 144, for instance, along opposite lateral edge portions of the second lining assembly region 144, may comprise a male mating mechanism 136 suitable for engaging with the female mating mechanism. Extended edge portions 130, 132 may be suitable for grasping by a user to insert the lining assembly 140 into the cavity of the exterior shell assembly or remove the lining assembly, 140 from the cavity of the exterior shell assembly.

In further additional embodiments, lining assembly 140 may comprise elastic material suitable for forming an elastic edge for the lining assembly 140 and allows the lining assembly 140 to be easily attached to the waste collection apparatus exterior shell assembly and allows a self-seal of the lining assembly 140 about the perimeters of the exterior shell assembly halves. The lining assembly 140 may thus function as an integral attachment and sealing feature and simplifies bag installation and sealing. It is further contemplated that the waste collection apparatus 100 may be utilized in conjunction with ordinary plastic liners known in the art bags or with no liner bag at all.

It should further be noted that a lining assembly 140 may be loaded in anticipation of use of the device (e.g., the user may load a lining assembly 140 before going on a walk with their dog) and the waste collection apparatus 100 may remain closed for the walk until use of the apparatus 100 is necessary. Alternatively, a lining assembly 140 may be installed just prior to use of the waste collection apparatus 100.

Lining assembly 140 may be square, rectangular, glove-shaped, mitten-shaped, that is having just a thumb-receiving portion adjacent to a central pouch space, or have other shapes suitable for the particular embodiment of practicing the invention. A plurality of lining assemblies can be provided in a common dispenser and dispensed together. Lining assembly 140 may be dispensed flat and after collecting waste lining assembly 140 may be sealed.

Lining assembly 140 may be flushable. Flushable lining assembly may comprise a water soluble plastic such as polyvinyl alcohol film. In embodiments, lining assembly 140 may be composed of a cold water soluble plastic foil. Lining assembly may alternatively comprise a water-soluble adhesive gel. Flushable lining assembly may comprise a flushable paper having sufficient structural integrity to allow lining assembly to be carried from the pet waste collection site to a toilet without lining assembly 140 disintegrating in the process. Suitable papers for lining assembly 140 include those typically used to manufacture flushable tissue or toilet paper and can accordingly comprise papermaking fibers derived from wood pulp in all its varieties. Suitable wood pulps may include chemical pulps and mechanical pulps such as are well known in the art. Other suitable materials for fabrication can include cellulosic fibrous pulps, also well known in the art.

The paper should include one or more temporary wet strength additives that impart sufficient wet strength to the paper while permitting lining assembly 140 to decay upon soaking in water, thus facilitating passage of lining assembly 140 and the pet excrement through the septic or sewage system. The paper may also include various non-fibrous materials such as fillers and adhesives or other materials employed during papermaking or when converting the paper into the finished product, for example a two-ply tissue paper. In a preferred embodiment, the paper consists essentially of these components that lend it these temporary wet strength and decay-on-soaking properties, that is, paper lining assembly 140 preferably does not include a substantial amount of one or more permanent wet strength additives or other materials such as polymeric materials that do not decay rapidly when soaked. Suitable temporary wet strength resins include any that provide a temporary wet strength property.

Tissue paper useful for fabricating lining assembly 140 includes single-ply, two-ply, and other plies or thicknesses capable of providing both the structural integrity and the breakdown in water characteristics as discussed above. The tissue paper may be embossed or plain the choice of which may depend on a variety of factors such as the desired thickness, tear-resistance, absorbency, and other properties.

In one embodiment, lining assembly 140 is preferably waterproof or nonabsorbent to provide protection from contact with the pet waste and to protect paper lining assembly 140 from contact with rain or moisture that could prematurely degrade lining assembly 140 prior to disposal. Although lining assembly 140 may be transparent, it is preferably opaque or colored to hide the contents from view since lining assembly 140 may be subject to unsightly discoloration from its contents until ultimately disposed of. Lining assembly 140 is preferably flexible plastic and can comprise polyethylene or other suitable polymeric or copolymeric materials, and films and laminates made therefrom, as are well known in the art. Alternatively, lining assembly 140 may comprise a fabric having a suitable waterproofing constituent as are well known in the art.

The invention can comprise a kit including one or more lining assemblies 140 with or without means for collecting the pet waste. The kit may include a plurality of lining assemblies 140 provided individually, in the form of rolls or stacks, or in a dispenser or dispensers. The kit can further comprise a carrying device such as a shoulder or belt-strapped pouch (not illustrated) or the like. The kit, or other marketed product, may include a reminder that lining assembly 140 is flushable printed directly on a surface of lining assembly 140 or included elsewhere in the kit or the product.

Paper suitable for fabricating lining assembly 140 may include fibers derived from recycled paper, or may comprise recycled fragments held together with a temporary or soluble cement or binding agent. Material suitable for fabricating lining assembly 140 also includes suitable non-paper materials providing the necessary flushable and temporary wet strength characteristics as described above. For example, a water soluble polymer film or plastic foil that dissolves when placed in cold water is a suitable material with which to fabricate lining assembly 140.

In another embodiment of the invention, lining assembly 140 is fabricated as above so as to be at once flushable and compostable. It can then be used for the collection of small amounts of organic material that needs to be transported to a composting site. Compostable material, including pet waste if the composting arrangement at the site is suitable for it, may then be picked up at a first location and placed in compostable lining assembly 140, lining assembly 140 then placed inside protective lining assembly 140 as above, and the compostable material transported from the first location to a second location where lining assembly 140 is removed from protective lining assembly 140 and along with the compostable material is disposed of in a suitable composting area, device, system, or composting toilet. This embodiment comprises no materials that fail tests for toxicity, that are not biodegradable in the short term, or that interfere with the decomposition of other organic material in any way. Suitable materials for lining assembly 140 include unbleached tissues, water soluble, non-toxic, organic or inert additives, binders or bond-makers, and cold water soluble, non-toxic polymer films.

Waste collection apparatus 100 may be suitable for collecting waste that has been deposited in a plurality of configurations. For instance, if the waste material is contained in a "pile" the waste collection apparatus 100 with a lining assembly in position is placed over the waste material with the interior shielding assembly in an "up" position or ready position within the exterior shell assembly. A thin flexible sheet material trailing from the lining assembly may be positioned to the rear of an exterior shell component. This allows the open area of the exterior shell component to pass over the waste material. When the exterior shell component is touching the ground the pet owner manually rotates the tab on the sidewall of the interior shielding assembly in a clockwise direction.

As the front edge of the interior shielding assembly 108 scoops under the waste material the flexible sheet material begins to seal the waste material within the lining assembly 140 in the interior shielding assembly 108. When the interior shielding assembly has been rotated 180 degrees the waste is contained and sealed within the interior shielding assembly or liner 140. The waste collection apparatus 100 may be suitable for discretely transporting the waste material sealed until a suitable trash or waste receptacle is reached. Then the interior shielding assembly is manually slid laterally out of the exterior shell assembly and the lining assembly 140 containing the waste material is disposed of. A new lining assembly 140 may be loaded onto the interior shielding assembly, and the interior shielding assembly and lining assembly 140 may then be inserted into the exterior shell assembly. The waste collection apparatus 100 is now ready for another use.

The second method of operation is like the first except for the following: If the waste material is not piled, but rather, spread out in a random fashion, the interior shielding assembly and/or lining assembly 140 are removed from the exterior shell assembly. The pet owner uses the interior shielding assembly and lining assembly 140 to move the waste material into a pile. The interior shielding assembly is then laid concave side down over the waste with the flexible sheet material component of the lining assembly 140 to the rear and flat on the ground. The waste collection apparatus exterior shell assembly is then brought in behind the interior shielding assembly 108. The pet owner slightly lifts the rear of the interior shielding assembly and as the exterior shell assembly is slid under the interior shielding assembly 108, then rotates clockwise the protruding tab on the interior shielding assembly 108. As the interior shielding assembly is rotated it starts to seal the lining assembly 140 and when the interior shielding assembly has rotated 180 degrees the waste is sealed in the disposable lining assembly 140 and the interior shielding assembly is back within the exterior shell assembly. The waste is discretely sealed and ready to be disposed of properly.

The waste collection apparatus 100 may be utilized in a scoop-like manner. This is useful in the event that the waste material is not deposited in a single location. In one embodiment, the waste collection apparatus 100 may be placed directly over or along side the waste material. A user may depress the release mechanism of the opening assembly, thereby separating the jaw ends of the exterior shell assembly components 114, 116 and revealing the interior shielding assembly and the lining assembly 140. The apparatus 100 may then be lowered over the waste material, preferably until the jaw ends of the exterior shell assembly components 114, 116 contact the ground. The user may cause the jaw ends of the exterior shell assembly components 114, 116, which are covered by a lining assembly 140 to slide underneath the waste material. The user may then release the release mechanism, and the exterior shell assembly components 114, 116 may return to their initial position proximate each other. At this point, the waste material is captured inside the lining assembly 140. The lining assembly 140 may be secured closed by securing tabs located on opposing ends of the lining assembly. Securing tabs may be snap, hook and loop, adhesive, or comprise a like fastening mechanism suitable for maintaining an appropriate seal of the lining assembly 140 to prevent the collected waste from exiting the lining assembly 140.

Waste collection apparatus 100 may be operated by a left hand or a right hand. By placing the elliptical protrusion or tab on the interior shielding assembly on the right hand side of the exterior shell component, the handle assembly 104 is ergonomically designed for a right-handed person. For left-handed people the interior shielding assembly is loaded so the protrusion or tab is on the left side of the exterior shell component.

Waste collection apparatus 100 may be coupled to a pre-existing retractable leash. The waste collection apparatus handle assembly 104 may be removed, the top area of the exterior shell assembly has a molded docking area such as a mounting plate 106 which allows the lower portion of any standard retractable leash to be connected to the waste collection apparatus 100. Waste collection apparatus 100 may be coupled to a retractable leash via industrial strength hook and loop strips placed within the contours of the outer surfaces of the waste collection apparatus mounting area and the lower portion of the retractable leash. The converging angles of the mounting device area also compress the retractable leash as it is placed into the waste collection apparatus mounting device 106.

Waste collection apparatus 100 may be coupled to a standard leather, nylon or other such material leash. In this configuration, the handle assembly 104 is docked to the exterior shell assembly 114, 116. The aperture 122 disposed on the bracket member 126 at the front end of the handle assembly 104 may be suitable for insertion of a metal ring or other such coupling device therethrough. The coupling device may be utilized to couple to the handle portion of a standard leash to the handle assembly 104 of the waste collection apparatus 100. This configuration provides a more ergonomic handle assembly 104 by which to control the pet and when docked with waste collection apparatus 100 operates as described above.

Waste collection apparatus addresses all of the above problems in that it's preparation for use and time to pick up waste material is extremely short, the pet owner never has to use their hands to grasp the waste material, the waste container is neatly contained within the housing so it is out of sight, the waste collection apparatus is integrated into the leash system so the waste is not carried by the free hand nor is it carried separately by the leash hand.

Waste collection apparatus 100 components may be formed from plastic, nylon, or other synthetic or composite materials. Also, exterior shell assembly 114, 116, and one or more concentric interior shielding assemblies and lining assembly 140 may be formed from a disposable and bio-degradable material such as plastic, paper, or other synthetic or composite material. In additional embodiments, components may be composed of, stainless steel, aluminum or a like metal or metal alloy to provide increased strength and substantially prevent corrosion. The handle assembly 104, exterior shell assembly, interior shielding assembly and lining assembly 140 may be formed in a plurality of colors.

It is further contemplated that all components of the waste collection apparatus 100 may be formed by injection molding such as acrylonitrile-butadiene-styrene (ABS) plastic injection molding, nylon and the like, or may be machined. It is further contemplated that components may be manufactured in any suitable manner. In one embodiment, handle assembly 104 may be composed of ABS or nylon, and may be injection molded, machined or the like. The interior shielding assembly formed by injection molding polypropylene or other synthetics, and the lining assembly 140 may be formed by vacuum forming bio-degradable plastic or other bio-degradable material.

The waste collection apparatus 100 integrates its form and function with traditional leashes by utilizing a metal clip through the eyelet in the handle assembly 104 or with commonly used retractable leashes by removing the handle assembly 104 and connecting the retractable leash to the mounting feature on the exterior shell assembly of waste collection apparatus. The device efficiently uses material resources, and the contours and vibrant colors of this device make it an esthetically pleasing addition to animal walking equipment.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed:

1. A lining assembly for lining an apparatus for collecting waste comprising:

a first lining region defining a first containing area, the first lining region including at least two protruding ledges positioned to extend substantially outward from opposite edges of the first lining region and at least one folded over region extending substantially across at least one edge of the first lining region forming a slot through which an edge of a waste collection assembly may be inserted;

a second lining region defining a second containing area hingedly coupled to the first lining region, the second lining region including at least two protruding ledges positioned to extend substantially outward from opposite edges of the second lining region and at least one folded over region extending substantially across at least one side of the second lining region forming a slot through which an edge of a waste collection assembly may be inserted; and a pivot axis formed from the a hinged coupling of the first lining region and the second lining region configured to allow the first lining region and the second lining region to substantially form an enclosed region when the edges of the first lining region and the second lining region are in contact, wherein the at least one folded over region of the first lining region and the second lining region extends across at least three edges of the first lining region and the second lining region, creating a slot on at least one edge of the first lining region not coupled to the second lining region and at least one edge of the second lining region not coupled to the first lining region through which an edge of a waste collection apparatus may be inserted.

2. The lining assembly as claimed in claim 1, wherein the lining assembly is composed of a biodegradable material.

3. The lining assembly as claimed in claim 1, wherein the first and second lining regions are molded to conform to the shape of interior cavity regions defined by an exterior shell assembly of a waste collection apparatus.

4. A lining assembly for lining an apparatus for collecting waste comprising:

a first lining region defining a first containing area, the first lining region including at least two protruding ledges positioned to extend substantially outward from opposite edges of the first lining region and at least one folded over region extending substantially across at least one edge of the first lining region forming a slot through which an edge of a waste collection assembly may be inserted;

a second lining region defining a second containing area coupled to the first lining region, the second lining region including at least two protruding ledges positioned to extend substantially outward from opposite edges of the second lining region and at least one folded over region extending substantially across at least one side of the second lining region forming a slot through which an edge of a waste collection assembly may be inserted, the first lining region and the second lining region being hingedly connected; and a pivot axis formed from the hinged connection of the first lining region and the second lining region configured to allow the first lining region and the second lining region to substantially form an enclosed region when the edges of the first lining region and the second lining region are in contact;

a plurality of first tab assemblies disposed on the at least one protruding ledges of the first lining region; and a plurality of second tab assemblies disposed on the at least one protruding ledges of the second lining region matable with the plurality of first tab assemblies.

5. The lining assembly as claimed in claim 4, wherein the first and second lining regions are semi-cylindrical or bowl-shaped.

6. The lining assembly as claimed in claim 4, wherein the first and second lining regions are molded to conform to the shape of interior cavity regions defined by an exterior shell assembly of a waste collection apparatus.

7. The lining assembly as claimed in claim 4, further including an elastic material suitable for forming an elastic edge substantially about the perimeter of the first and second lining regions forming a self seal of the first and second lining regions about the perimeter of the regions of the waste collection apparatus about which the first and second lining regions are positioned.

8. The lining assembly as claimed in claim 4, wherein the lining assembly is composed of a flexible plastic including a polyethylene, polymeric or copolymeric material.

9. The lining assembly as claimed in claim 4, wherein the lining assembly is composed of a biodegradable material.

10. The lining assembly as claimed in claim 4, wherein the at least one folded over region of the first lining region and the second lining region extends across at least three edges of the first lining region and the second lining region, creating a slot on at least one edge of the first lining region not coupled to the second lining region and at least one edge of the second lining region not coupled to the first lining region through which an edge of a waste collection apparatus may be inserted.

11. A lining assembly for lining an apparatus for collecting waste comprising:

a first semi-cylindrical lining region, the first semi-cylindrical lining region including at least one protruding ledge positioned to extend substantially outward from an edge of the first semi-cylindrical lining region and at least one folded over region extending substantially across at least one side of the first semi-cylindrical lining region forming a slot through which an edge of a waste collection assembly may be inserted;

a second semi-cylindrical lining region coupled to the first semi-cylindrical lining region, the second semi-cylindrical lining region including at least one protruding ledge positioned to extend substantially outward from an edge of the second semi-cylindrical lining region and at least one folded over region extending substantially across at least one side of the second semi-cylindrical lining region forming a slot through which an edge of a waste collection assembly may be inserted, the first semi-cylindrical lining region and the second semi-cylindrical lining region being hingedly connected;

a substantially centrally located pivot axis formed from the hinged connection of the first semi-cylindrical lining region and the second semi-cylindrical lining region configured to allow the first semi-cylindrical lining region and the second semi-cylindrical lining region to substantially form a cylinder when the edges of the first semi-cylindrical lining region and the second semi-cylindrical lining region are in contact;

a plurality of first tab assemblies disposed on the at least one protruding ledges of the first semi-cylindrical lining region; and a plurality of second tab assemblies disposed on the at least one protruding ledges of the second semi-cylindrical lining region matable with the plurality of first tab assemblies.

12. The lining assembly as claimed in claim 11, wherein the lining assembly is composed of a thin semi ridged plastic, composite, synthetic or organic biodegradable material.

13. The lining assembly as claimed in claim 11, further including a flexible sheet of material coupled to the at least one protruding ledge of the first semi-cylindrical lining region or the second semi-cylindrical lining region and extending outward from the first semi-cylindrical lining region or the second semi-cylindrical lining region.

14. The lining assembly as claimed in claim 13, wherein the flexible sheet of material is coated with a light adhesive for contacting the flexible sheet.

15. The lining assembly as claimed in claim 11, further including at least a second protruding ledge positioned substantially opposite the at least one protruding ledge of the first semi-cylindrical lining region.

16. The lining assembly as claimed in claim 11, further including at least a second protruding ledge positioned substantially opposite the at least one protruding ledge of the second semi-cylindrical lining region.

17. The lining assembly as claimed in claim 11, wherein the at least one folded over region of the first semi-cylindrical lining region and the second semi-cylindrical lining region extends across at least three edges of the first semi-cylindrical lining region and the second semi-cylindrical lining region, creating a slot on at least one edge of the first semi-cylindrical lining region not coupled to the second semi-cylindrical lining region and at least one edge of the second semi-cylindrical lining region not coupled to the first semi-cylindrical lining region through which an edge of a waste collection apparatus may be inserted.

18. The lining assembly as claimed in claim 11, wherein the plurality of first tab assemblies and the plurality of second tab assemblies are first and second snap or tab mechanisms configured to mate to provide a secure closure of the first semi-cylindrical lining region and the second semi-cylindrical lining region.

19. The lining assembly as claimed in claim 11, wherein the at least one protruding edge of the first cylindrical lining region and the second cylindrical lining region are graspable.

* * * * *